US008438880B2

(12) United States Patent
Bolduan et al.

(10) Patent No.: US 8,438,880 B2
(45) Date of Patent: May 14, 2013

(54) DETERGENT DISPENSING UNIT

(75) Inventors: Edwin Bolduan, Berlin (DE); Horst Wiemer, München (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1461 days.

(21) Appl. No.: 11/886,402

(22) PCT Filed: Jan. 17, 2006

(86) PCT No.: PCT/EP2006/050259

§ 371 (c)(1),
(2), (4) Date: Sep. 13, 2007

(87) PCT Pub. No.: WO2006/097370

PCT Pub. Date: Sep. 21, 2006

(65) Prior Publication Data

US 2008/0148786 A1 Jun. 26, 2008

(30) Foreign Application Priority Data

Mar. 17, 2005 (DE) ..... 10 2005 012 424

(51) Int. Cl.
*D06F 39/02* (2006.01)

(52) U.S. Cl.
USPC ..... 68/17 R

(58) Field of Classification Search ..... 68/17 R
See application file for complete search history.

(56) References Cited

FOREIGN PATENT DOCUMENTS

| | | | |
|---|---|---|---|
| DE | 1 460 837 | | 4/1969 |
| DE | 1 800 128 | | 4/1970 |
| DE | 42 22 736 | | 1/1994 |
| DE | 296 20 945 | U | 4/1998 |
| DE | 29809955 | U1 * | 6/1998 |
| DE | 298 09 955 | U | 8/1998 |
| EP | 0 597 274 | | 5/1994 |
| GB | 1134483 | | 11/1968 |
| GB | 2043433 | A * | 10/1980 |

OTHER PUBLICATIONS

International Search Report PCT/EP2006/050259.

* cited by examiner

*Primary Examiner* — Michael Barr
*Assistant Examiner* — Jason Riggleman
(74) *Attorney, Agent, or Firm* — James E. Howard; Andre Pallapies

(57) ABSTRACT

A detergent dispensing unit is provided that includes a dispensing shell; a dispensing connection permitting the entry of fresh water into the dispensing shell; and a trap being located fluidly between an interior of the detergent dispensing unit and an opening that leads to the exterior, the opening which leads to the exterior being an overflow. The trap is positioned in the dispensing shell downstream of the dispensing connection, a maximum filled level of the trap lies below a lower edge of the overflow and the trap is adapted to be filled by liquid from the dispensing shell.

20 Claims, 1 Drawing Sheet

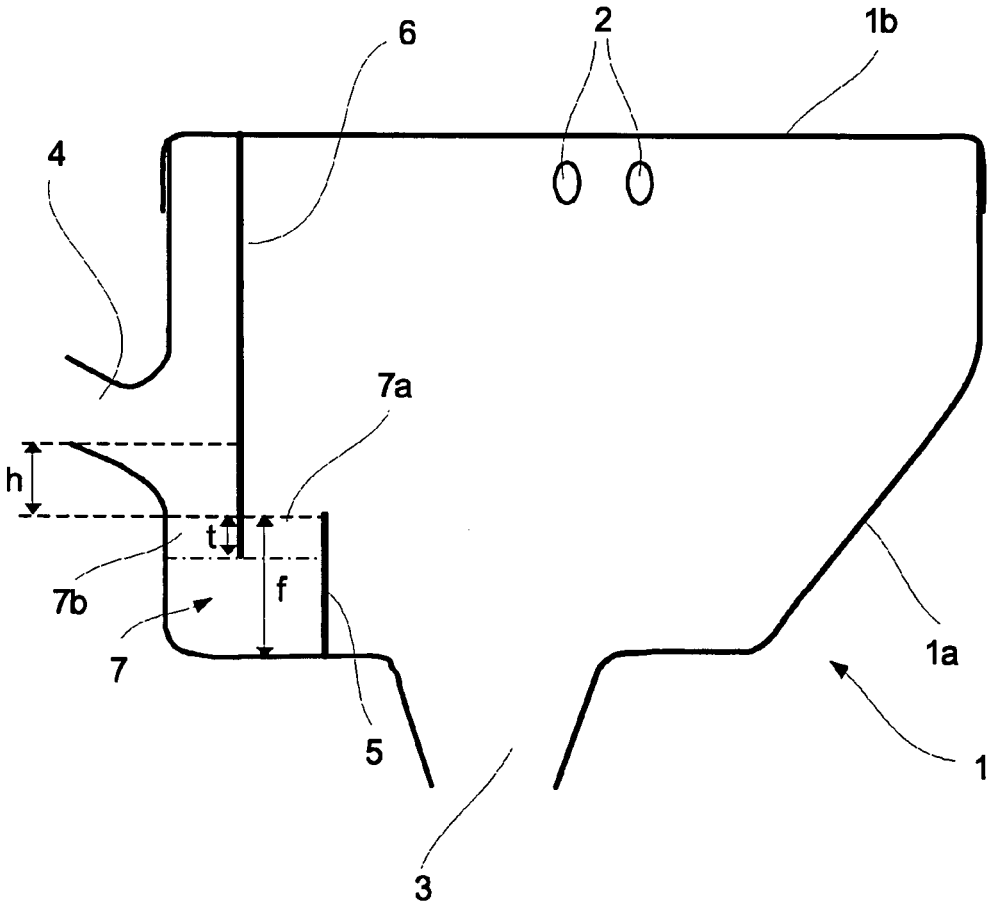
6
2
1b
4
7a
h
t
f
7b
7
5
1a
1
3

DETERGENT DISPENSING UNIT

The invention relates to a detergent dispensing unit for a washing machine and a corresponding washing machine.

Washing machines can suffer if water vapor is able to enter the machine interior, because this can cause electrical components to become wet and break down.

Washing machines are generally known which incorporate an overflow leading into the machine interior which conducts water away from the detergent dispensing unit, in particular the dispensing shell. Water vapor rising from the tub into the detergent dispensing unit can, however, enter the machine interior via the overflow.

DE 296 20 945 U1 discloses a washing machine in which an overflow hose, which features a foam barrier, is attached to the detergent inflow pipe in order to hold back the foam rising up from the tub. Liquid exiting through the open end of the hose is conducted to the bottom of the machine.

DE 298 09 955 U1 discloses a washing machine which has a detergent dispensing unit with at least one fresh water connection, a downstream free air gap and a water conduit for guiding the fresh water into a detergent chamber in order to provide water vapor-tight ventilation of a free air gap. A ventilation unit in the form of a siphon-type passage is arranged below the free air gap in such a way that the siphon can be filled by the spray water arising while crossing the free air gap. The siphon separates the interior of the detergent dispensing unit from a shaft which is open to the top.

The object of the present invention is to reduce the amount of water vapor escaping in particular from the tub into the machine.

This object is fulfilled by a detergent dispensing unit and a washing machine as recited in the claims.

The detergent dispensing unit comprises at least one dispensing shell with at least one dispensing connection permitting the entry of fresh water, at least one overflow leading to the exterior and a siphon-type passage or trap between the interior of the dispensing shell and the overflow. As the trap is in the dispensing shell it is positioned downstream of the dispensing connection as regards the direction of flow of the fresh water and does not create an effective connection with the upstream free air gap. The trap is designed in such a way that—in fault-free operation—its maximum filled level is below the bottom edge of the overflow; its end facing the interior of the dispensing shell must therefore be lower than the bottom edge of the overflow. The trap can be filled by any liquid in the dispensing shell, in particular leaked water.

The use as described above of the trap creates a water vapor-tight connection between the interior of the detergent dispensing unit, in particular the dispensing shell, and the overflow. The arrangement therefore produces an overflow with an integrated water vapor barrier. Water vapor rising up from the tub can no longer enter the machine interior via the dispensing shell. As the maximum filled level of the trap is below the lower edge of the overflow, the intended overflow function, including the required overflow level, can be maintained.

For a simple and inexpensive implementation it is advantageous if the trap comprises a reservoir formed by side walls of the dispensing shell and by a lower wall taken through the interior of the dispensing shell. The reservoir is also divided into an interior part and an exterior part by an upper partition which is deeper throughout than the edge of the lower wall. As a result, the interior part of the reservoir is opened to the interior of the dispensing shell and can be filled from it, e.g. by leaked or sprayed water, etc. The exterior part of the shell is opened to the overflow, which is preferably integrated in at least one side wall. The edge of the lower wall which determines the maximum filled level is at least partially lower than the lower edge of the overflow so that the overflow level is maintained in the detergent dispensing unit.

It is particularly advantageous if the upper partition is at least 5 mm lower than the edge of the lower wall—and the immersion depth t at maximum filled level f of the tub is therefore at least 5 mm—because this creates a correspondingly deep, effective water vapor barrier.

In an advantageous embodiment of the invention, the trap is arranged sideways in the dispensing shell.

It is advantageous for simple and inexpensive manufacture and installation, particularly without additional parts, if the dispensing shell is divided into at least two parts, with at least a lower part and an upper part, and if the reservoir is integrated in the lower part of the dispensing shell and the upper partition is integrated in the upper part of the dispensing shell.

The object is also achieved by a washing machine with a detergent dispensing unit or dispensing shell configured in accordance with the invention.

In the following exemplary embodiment the detergent dispensing unit is presented schematically in more detail, in which;

FIG. 1 shows a dispensing shell as part of a detergent dispensing unit of a washing machine in a schematic sideways cutaway view.

FIG. 1 shows a dispensing shell 1 with dispensing connection 2 for dispensing (here downwards at an angle) fresh water to the dispensing shell 1 or components contained in it such as detergent chambers (not shown here). The dispensing shell 1 consists of a lower part 1*a* and an upper part 1*b*. The lower part of the dispensing shell 1 incorporates an outlet 3 to the tub (not shown). An overflow 4 with a rectangular cross-section and leading to the exterior is located in a side wall.

A lower wall 5 is integrated in the lower part 1*a* of the dispensing shell 1 and together with the connected side walls forms a reservoir 7. The reservoir 7 is divided by an upper partition 6 which extends deeper than the edge of the lower wall 5 into an interior part 7*a* and an exterior part 7*b*, which creates a water vapor barrier. These two parts 7*a*, 7*b* correspond functionally to the sides of a trap; the side height of the interior part 7*a* is determined by the deepest edge of the lower wall 5 or the wall height, the side height of the exterior part 7*b* is determined by the lower edge of the overflow 4. To ensure the required overflow level h the edge of the lower wall 5 lies correspondingly lower than the lower edge of the overflow 4; the height of the lower wall 5 corresponds here to a maximum filled level f of the reservoir 7. The reservoir 7 can be filled by the liquid in the dispensing shell, in particular leaked water. In this exemplary embodiment, the immersion depth t in the upper partition 6 is approx. 5 mm at the maximum filled level f.

The reservoir 7 is filled during every fault-free inflow of fresh water. If, e.g. during a "hot boost" of typically 60° C. to 70° C., water vapor rises up from the tub through outlet 3 it cannot pass through the trap into the machine owing to the water vapor barrier but will instead settle on the panel lid or similar, or will escape through the gap between the dispensing shell 1 and the panel lid. A "hot boost" is part of a hot water program which is operated with a typical temperature of for example 40° C. in which the washing liquid is briefly or quickly heated up to a higher temperature, e.g. 60° C. to 70° C.

On a faulty machine—e.g. with a faulty water regulator—the water rises via outlet 3 into the dispensing shell and on reaching the overflow 4 flows into the machine.

The shape of the reservoir 7 can be adapted to the design requirements of the dispensing shell 1 and the detergent dispensing unit. It can have a straight or inclined upper partition 6 and/or a straight or angled lower wall 5. The walls can also be differently and variably shaped, e.g. with variable height, for example with recesses such as notches etc. The position of the reservoir 7 can also be different from that shown in the drawing.

The invention claimed is:

1. A detergent dispensing unit comprising:

a dispensing shell and a dispensing connection permitting the entry of fresh water into the dispensing shell; and a trap being located fluidly between an interior of the detergent dispensing unit and an opening that leads to the exterior, the opening which leads to the exterior being an overflow, wherein the trap is positioned in the dispensing shell downstream of which the dispensing connection, a maximum filled level of the trap lies below a lower edge of the overflow and the trap is adapted to be filled by liquid from the dispensing shell.

2. The dispensing unit as claimed in claim 1, wherein the trap comprises a reservoir including side walls and a lower wall and being divided by an upper partition that extends down into the reservoir and has a lower edge that extends below an upper edge of the lower wall, the upper partition dividing the reservoir into an interior part and an exterior part, the interior part of the reservoir being opened to the interior of the dispensing shell and being capable of being filled from it, the exterior part of the reservoir being opened to the overflow, and the edge of the lower wall lying at least partially below the lower edge of the overflow.

3. The dispensing unit as claimed in claim 1, wherein the upper partition extends throughout at least 5 mm lower than the lowest point of the upper edge of the lower wall.

4. The dispensing unit as claimed in claim 1, wherein the interior part and the exterior part of the trap are arranged horizontally with respect to each other in the dispensing shell.

5. The dispensing unit as claimed in claim 1, wherein the reservoir is integrated in a lower part of the dispensing shell and the upper partition is integrated in an upper part of the dispensing shell.

6. The detergent dispensing unit as claimed in claim 2, wherein the opening that leads to the exterior is an overflow that diverts fluid to an area outside of the dispensing shell.

7. The detergent dispensing unit as claimed in claim 1, wherein the opening that leads to the exterior is an overflow that diverts fluid to an area outside of the dispensing shell.

8. The detergent dispensing unit as claimed in claim 7, wherein the trap provides a water vapor-tight connection between the interior of the detergent dispensing unit and the opening that leads to the exterior.

9. The detergent dispensing unit as claimed in claim 2, wherein the trap provides a water vapor-tight connection between the interior of the detergent dispensing unit and the opening that leads to the exterior.

10. The detergent dispensing unit as claimed in claim 1, wherein the trap provides a water vapor-tight connection between the interior of the detergent dispensing unit and the opening that leads to the exterior.

11. A washing machine comprising:

a housing;

a detergent dispensing unit disposed within the housing and including:

a dispensing shell and a dispensing connection permitting the entry of fresh water into the dispensing shell; and a trap being located fluidly between an interior of the detergent dispensing unit and an opening that leads to the exterior, the opening which leads to the exterior being an overflow, wherein the trap is positioned in the dispensing shell downstream of which the dispensing connection, a maximum filled level of the trap lies below a lower edge of the overflow and the trap is adapted to be filled by liquid from the dispensing shell.

12. The washing machine as claimed in claim 11, wherein the trap comprises a reservoir including side walls and a lower wall and being divided by an upper partition that extends down into the reservoir and has a lower edge that extends below an upper edge of the lower wall, the upper partition dividing the reservoir into an interior part and an exterior part, the interior part of the reservoir being opened to the interior of the dispensing shell and being capable of being filled from it, the exterior part of the reservoir being opened to the overflow, and the edge of the lower wall lying at least partially below the lower edge of the overflow.

13. The washing machine as claimed in claim 11, wherein the upper partition extends throughout at least 5 mm lower than the lowest point on the upper edge of the lower wall.

14. The washing machine as claimed in claim 11, wherein the interior part and the exterior part of the trap are arranged horizontally with respect to each other in the dispensing shell.

15. The washing machine as claimed in claim 11, wherein the reservoir is integrated in a lower part of the dispensing shell and the upper partition is integrated in an upper part of the dispensing shell.

16. The washing machine as claimed in claim 12, wherein the opening that leads to the exterior is an overflow that diverts fluid to an area outside of the dispensing shell.

17. The washing machine as claimed in claim 11, wherein the opening that leads to the exterior is an overflow that diverts fluid to an area outside of the dispensing shell.

18. The washing machine as claimed in claim 17, wherein the trap provides a water vapor-tight connection between the interior of the detergent dispensing unit and the opening that leads to the exterior.

19. The washing machine as claimed in claim 12, wherein the trap provides a water vapor-tight connection between the interior of the detergent dispensing unit and the opening that leads to the exterior.

20. The washing machine as claimed in claim 11, wherein the trap provides a water vapor-tight connection between the interior of the detergent dispensing unit and the opening that leads to the exterior.

* * * * *